US007497163B2

(12) United States Patent
Roth

(10) Patent No.: US 7,497,163 B2
(45) Date of Patent: Mar. 3, 2009

(54) PRINTING UNIT OF A PRINTING PRESS AND METHOD FOR CARRYING OUT A PRINTING-PLATE CHANGE ON A FORME CYLINDER OF A PRINTING UNIT

(75) Inventor: Heiko Roth, Kürbitz (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 550 days.

(21) Appl. No.: 11/242,652

(22) Filed: Oct. 4, 2005

(65) Prior Publication Data

US 2006/0070542 A1 Apr. 6, 2006

(30) Foreign Application Priority Data

Oct. 5, 2004 (DE) ..... 10 2004 048 315

(51) Int. Cl.
*B41F 33/16* (2006.01)
*B41F 27/12* (2006.01)

(52) U.S. Cl. ..... 101/485; 101/477

(58) Field of Classification Search ..... 101/247, 101/477, 485, 486, DIG. 36
See application file for complete search history.

(56) References Cited

U.S. PATENT DOCUMENTS

| | | | |
|---|---|---|---|
| 4,827,842 | A | 5/1989 | Theilacker et al. |
| 5,390,603 | A | 2/1995 | Hauck et al. |
| 5,826,505 | A | 10/1998 | Volz et al. |
| 5,904,093 | A | 5/1999 | Pollock |
| 5,937,149 | A | 8/1999 | Linder et al. |
| 6,119,593 | A | 9/2000 | Pollock |
| 6,205,926 | B1 | 3/2001 | Dufour |
| 2002/0124745 | A1 | 9/2002 | Pautrat |

FOREIGN PATENT DOCUMENTS

| | | |
|---|---|---|
| DE | 36 44 445 | 7/1988 |
| DE | 42 23 583 | 1/1994 |
| DE | 196 23 224 | 9/1997 |
| DE | 196 36 703 | 3/1998 |
| DE | 198 32 917 | 2/1999 |
| DE | 199 42 619 | 4/2000 |
| DE | 100 46 367 | 4/2002 |
| DE | 102 06 891 | 9/2002 |
| EP | 0 363 803 A2 | 4/1990 |
| EP | 0 533 307 | 3/1993 |
| EP | 0 363 803 B1 | 8/1994 |
| EP | 0 934 826 | 8/1999 |
| EP | 1 431 034 | 6/2004 |

*Primary Examiner*—Leslie J Evanisko
(74) *Attorney, Agent, or Firm*—Cohen Pontani Lieberman & Pavane LLP

(57) ABSTRACT

A printing unit of a printing press includes a form cylinder and a transfer cylinder and an inking unit. A drive rotates the form cylinder to a position for effecting a printing plate change on the form cylinder in response to an actuating signal from a regulating a or control device. The actuating signal is determined as a function a circumferential register value of the form cylinder.

4 Claims, 1 Drawing Sheet

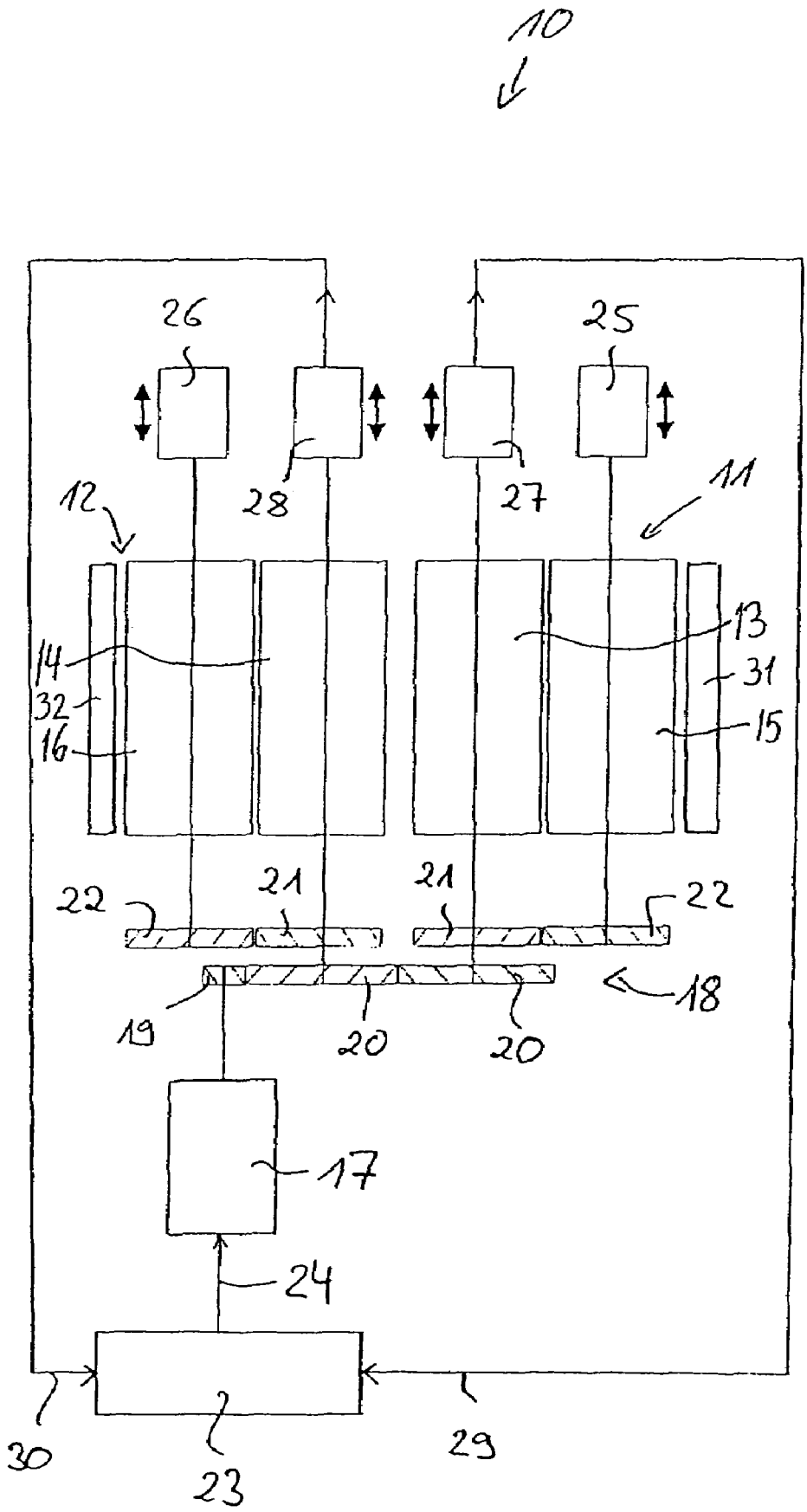
10
26
25
28
27
12
11
13
14
31
32
15
16
22
21
21
22
18
19
20
20
17
24
30
23
29

PRINTING UNIT OF A PRINTING PRESS AND METHOD FOR CARRYING OUT A PRINTING-PLATE CHANGE ON A FORME CYLINDER OF A PRINTING UNIT

BACKGROUND OF THE INVENTION

The present invention relates to a printing unit of a printing press having at least one press unit with a forme cylinder, a transfer cylinder, and an inking unit, at least one printing plate arrangeable on the forme cylinder, a drive for rotating the forme cylinder into a position or angular position which is suitable for effecting a printing-plate change, and a regulating or control device for supplying the drive with an actuating signal for rotating the forme cylinder into the position or angular position which is suitable for the printing-plate change. Furthermore, the invention relates to a method for carrying out the printing-plate change on the forme cylinder of the printing unit.

Printing units of web-fed rotary presses, in particular of newspaper presses, have a plurality of press units, every press unit comprising a transfer cylinder, a forme cylinder and an inking unit, as well as, optionally, a damping unit. Oil-less press units without a damping unit are also known. Furthermore, printing units of this type can have impression cylinders, it being possible for an impression cylinder to interact with one or more transfer cylinders of different press units. In addition to printing units which have impression cylinders of this type, printing units which do not have impression cylinders are also known, the transfer cylinders of two press units rolling on one another in printing units of this type without impression cylinders. As a rule, rubber blankets are clamped on the transfer cylinders and printing plates are clamped on the forme cylinders, for which reason the transfer cylinders are also designated blanket cylinders and the forme cylinders are also designated plate cylinders.

In order to carry out a printing-plate change on a forme cylinder of a printing unit, the respective forme cylinder can be rotated by way of a drive of the printing unit into a position or angular position which is suitable for carrying out the printing-plate change and in which the printing plate which is to be changed or exchanged can be grasped at its trailing edge or leading edge. The exact or precise movement to this position or angular position which is suitable for carrying out the printing-plate change or for grasping or gripping the printing plate which is to be changed is of decisive significance for carrying out the printing-plate change, as the trailing edge or leading edge of the printing plate can be grasped only in a narrowly defined angular range or positional range of the forme cylinder.

Furthermore, what are known as register values or register offset values have an influence on the position of the respective forme cylinder and thus on the moving to a position of the latter which is suitable for carrying out a printing-plate change, the positional accuracy of the colour separations on the printing material in relation to the outer edges of the printing material being ensured via register values or register offset values of this type. What is known as the circumferential register value or circumferential register offset plays a decisive role for moving to the position or angular position of the forme cylinder which is suitable for the printing-plate change.

In order to compensate for the circumferential register offset of a forme cylinder during the printing-plate change on the latter, the circumferential register value is set to zero before the actual printing-plate change, according to the prior art, and the printing unit is driven or displaced until the circumferential register offset for the forme cylinder assumes the value zero. Only subsequently is the forme cylinder rotated into the position or angular position which is suitable for the printing-plate change by way of the drive of the printing unit. After the printing-plate change has been carried out, the original circumferential register offset or circumferential register value is set again according to the prior art and the printing unit is displaced until the circumferential register offset for the forme cylinder has been moved to again. This zero setting and resetting of the circumferential register value or circumferential register offset before and after the actual printing-plate change are time-consuming. The circumferential register zero setting and circumferential register resetting can thus take up to two minutes. This is disadvantageous for reasons of productivity.

SUMMARY OF THE INVENTION

An object of the present invention is to provide a novel printing unit of a printing press and a novel method for carrying out a printing-plate change on a forme cylinder of a printing unit.

The object is met by a printing unit of a printing press in which a circumferential register value of a forme cylinder is fed to a regulating device or control device as an input variable, the regulating device or control device determining, as a function of the circumferential register value, the actuating signal for the drive and thus for the rotation of the forme cylinder into the position or angular position which is suitable for a printing-plate change.

According to the present invention, the actuating signal for the drive is determined as a function of the circumferential register value of the respective forme cylinder, for rotating the forme cylinder into the position or angular position which is suitable for the printing-plate change. Accordingly, it lies within the context of the present invention to couple the drive for rotating the forme cylinder, which drive operates completely independently of a register regulating device according to the prior art, to the register regulating device in such a way that the circumferential register value or circumferential register offset of the forme cylinders is read and fed to the regulating device or control device of the drive. Accordingly, in the context of the present invention, the actuating signal for the drive is adjusted for the circumferential register value or circumferential register offset, with the result that the time-consuming register zero setting and register resetting which are required according to the prior art can be dispensed with. The result of this is a considerable time saving for a printing-plate change.

The method according to the invention for carrying out a printing-plate change on a forme cylinder of a printing unit includes rotating the forme cylinder by a drive into a position or angular position which is suitable for carrying out the printing-plate change, in particular for grasping or gripping the printing plate which is to be changed, wherein the drive is supplied with an actuating signal for rotating the forme cylinder into the position or angular position which is suitable for the printing-plate change, and the actuating signal for the drive and thus for rotating the forme cylinder into the position or angular position which is suitable for the printing-plate change being determined as a function of a circumferential register value.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings:

The FIGURE is a schematic diagram of a detail of the printing-press cylinder according to the present invention.

DETAILED DESCRIPTION OF THE PRESENTLY PREFERRED EMBODIMENTS

The FIGURE schematically shows a detail of a printing unit 10 of a web-fed rotary press which includes two press units 11 and 12. Each of the press units 11, 12 has a blanket cylinder or transfer cylinder 13, 14 and a plate cylinder or forme cylinder 15, 16. A web-form printing material is guided through between the two transfer cylinders 13 and 14 to print a front side and rear side of the said printing material. Furthermore, the forme cylinders 15, 16 of the two printing units 11, 12 are assigned an inking 31, 32 unit to apply printing ink, and optionally a damping unit to apply damping solution, to the forme cylinders 15, 16, that is to say printing plates which are clamped on the forme cylinders 15, 16. Accordingly, at least one printing plate is clamped on each of the two forme cylinders 15 and 16.

In the exemplary embodiment shown, a drive 17 is assigned to the printing unit 10 for the rotational drive of the transfer cylinders 13 and 14 and the forme cylinders 15 and 16 of the printing unit 10. Via a gear mechanism 18 comprising a plurality of gear wheels 19, 20, 21 and 22, the drive 17 drives both the two transfer cylinders 13 and 14 and the two forme cylinders 15 and 16. A regulating device or control device 23 assigned to the drive 17 provides an actuating signal 24 for the drive 17.

According to the FIGURE, each of the forme cylinders 15, 16 is assigned a drive 25, 26, and each of the transfer cylinders 13, 14 is assigned a drive 27, 28. The drives 25, 26, 27 and 28 are configured as linear drives, with the aid of which the transfer cylinders 13 and 14 and the forme cylinders 15 and 16 can be displaced in the axial direction, in order to set register values or register offset values in this way for the forme cylinders 15 and 16. The forme cylinders 15 and 16 can be displaced in the axial direction with the aid of the linear drives 25 and 26, it being possible as a result to set a lateral register value or lateral register offset for the forme cylinders 15 and 16. The transfer cylinders 13 and 14 can be displaced in the axial direction via the linear drives 27 and 28, it being possible as a result, in interaction with helical toothing of the gear wheels 21 and 22, to set a circumferential register value or circumferential register offset for the forme cylinders 15 and 16. Accordingly, the drives 25, 26, 27 and 28 serve to set or provide the circumferential register value and the lateral register value for the respective forme cylinders 15 and 16, and are accordingly part of a register regulating device.

In order to carry out a printing-plate change on one of the forme cylinders 15 or 16 of the printing unit 10 according to the invention, the respective forme cylinder 15 or 16 is rotated by the drive 17 into a position or angular position which is suitable for the printing-plate change and in which the printing plate which is to be changed can be grasped or gripped at its leading edge or trailing edge. For this purpose, the regulating device or control device 23 outputs the actuating signal 24 to the drive 17.

In the context of the present invention, it is then proposed that the regulating device or control device 23 determines the actuating signal 24 for the drive 17 for rotating the respective forme cylinder 15 or 16 into the position which is suitable for the printing-plate change, as a function of the respective circumferential register value of the respective forme cylinder 15 or 16. For this purpose, the circumferential register values of the forme cylinders 15 and 16, which are set via the drives 27 and 28 in the exemplary embodiment shown, are provided to the regulating device or control device 23 as input variables 29 and 30. If the forme cylinder 16 is to be rotated into the position which is suitable for the printing-plate change, the actuating signal 24 for the drive 17 is formed as a function of the circumferential register value of the drive 28 which is supplied as an input variable 30. If, in contrast, the forme cylinder 15 is to be rotated into a position which is suitable for the printing-plate change, the actuating signal 24 of the drive 17 is formed as a function of the circumferential register value of the drive 27 which is supplied as an input variable 29. Accordingly, in the context of the present invention, the circumferential register value of the respective forme cylinder, on which a printing-plate change is to be carried out, is read and is taken into consideration when supplying the actuating signal 24 for the drive 17, on account of which actuating signal 24 the corresponding forme cylinder 15 or 16 is rotated into the position or angular position which is suitable for the printing-plate change. As a result, the printing-plate change can be accelerated considerably.

In order to determine the actuating signal 24 for the drive 17 for rotating the respective forme cylinder into the position or angular position which is suitable for the printing-plate change, the regulating device or control device 23 first of all determines an intermediate actuating signal which is independent of the respective circumferential register value, the intermediate actuating signal being combined in a calculation with the circumferential register value in such a way that the circumferential register value is added, with a reversed sign, to the intermediate actuating signal.

If, for example, the control device 23 stipulates an angular position which is required for the printing-plate change for the respective forme cylinder of +10°, independently of the circumferential register value, and the circumferential register value for this forme cylinder is +4°, the drive motor 17 is supplied with an actuating signal 24 which corresponds to an angular position for the forme cylinder of +6°.

In the context of the invention, the circumferential register value of a forme cylinder is compensated for during the determination of the actuating signal for the drive for rotating the respective forme cylinder into the position or angular position which is suitable for the printing-plate change. Accordingly, in the context of the present invention, the circumferential register offset of the respective forme cylinder on which a printing-plate change is to be performed is automatically compensated for during the positioning of the forme cylinder for the printing-plate change. In the context of the present invention, the register zero setting which is required before the actual printing-plate change according to the prior art and the register resetting which is required after the printing-plate change can be dispensed with, so that a considerable time saving results for the printing-plate change. The invention can be realized without additional mechanical or electrical assemblies, with the result that it can be implemented inexpensively on existing printer units.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A printing unit of a printing press, comprising:

a forme cylinder configured to receive a printing plate, a transfer cylinder and an inking unit, a drive configured to rotate the forme cylinder to a suitable position to effect a printing-plate change on the forme cylinder, and a regulating or control device connected to the drive to supply an actuating signal to the drive to rotate the forme cylinder into the suitable position, wherein the regulating or control device is arranged to receive a circumferential register offset value of the forme cylinder as an input variable, the actuating signal being determined as a function of the circumferential register offset value, and wherein the regulating device or control device determines an intermediate actuation signal independent of the circumferential register offset value, and combines in a calculation the intermediate actuating signal with the circumferential register offset value.

2. The printing unit of claim 1, wherein the circumferential register offset value is added with a reversed sign to the intermediate actuating signal to provide the actuating signal for the drive.

3. A method for effecting a printing-plate change on a forme cylinder of a printing unit, comprising the steps of:

determining an intermediate actuating signal for a drive to rotate the forme cylinder to a suitable position or suitable angular position to effect a printing-plate change as a function of a circumferential register offset value of the forme cylinder, said intermediate actuating signal being independent of the circumferential register offset value and being combined in a calculation with the circumferential register offset value;

supplying the actuating signal to the drive; and rotating the forme cylinder using the drive to the suitable position or the suitable angular position to perform the printing-plate change in response to the actuating signal.

4. The method of claim 3, wherein said step of combining comprises adding the circumferential register offset value, with a reversed sign, to the intermediate actuating signal.

* * * * *